US006435065B2

(12) United States Patent
Kozak et al.

(10) Patent No.: US 6,435,065 B2
(45) Date of Patent: Aug. 20, 2002

(54) TOOL HANDLE FOR STORING BITS

(76) Inventors: Burton Kozak, 1300 N. Lake Shore Dr., #28C, Chicago, IL (US) 60610; Ira M. Kozak, 2475 Woodlawn Dr., Northbrook, IL (US) 60062

( * ) Notice: Subject to any disclaimer, the term of this patent is extended or adjusted under 35 U.S.C. 154(b) by 0 days.

(21) Appl. No.: 09/748,497

(22) Filed: Dec. 26, 2000

Related U.S. Application Data

(63) Continuation-in-part of application No. 09/396,714, filed on Sep. 15, 1999, now abandoned.

(51) Int. Cl.[7] ..... B25G 1/08
(52) U.S. Cl. ..... 81/490; 81/177.4
(58) Field of Search ..... 81/490, 177.4, 81/177.1

(56) References Cited

U.S. PATENT DOCUMENTS 1,105,818 A * 8/1914 Moore ..... 81/490
4,235,269 A * 11/1980 Kraus ..... 81/438
4,327,790 A * 5/1982 Stevens et al. ..... 145/62
5,121,803 A * 6/1992 Hartmann et al. ..... 173/171
6,029,549 A * 2/2000 Baker ..... 81/439
6,032,332 A * 3/2000 Lin ..... 16/111.1

* cited by examiner

*Primary Examiner*—Joseph J. Hail, III
*Assistant Examiner*—David B. Thomas

(57) ABSTRACT

A bit-storing tool handle is provided that includes a surface of the handle defining a channel adapted to retain the bit, and a fulcrum point contained within the channel for rotating the retained bit out of the channel. The bit-storing tool handle may alternatively include a plurality of channels adapted to retain the bits such that the longitudinal axis of the retained bits are co-linear to the longitudinal axis of the handle and a fulcrum point within each of the channels that promotes the manual rotation of each of the bits about a cooperating fulcrum point so that upon such rotation, the bits extend radially from the longitudinal axis of the handle. The channels include an opening dimensioned and configured to allow the finger of a person to insert under a first end of the bit thereby facilitating the removal of the bit from the channel when an excessive amount of force is required to pivot the bit due to cold weather or similar conditions. The opening provides an alternative to the fulcrum point for the removal of the bit from the channel.

20 Claims, 5 Drawing Sheets

TOOL HANDLE FOR STORING BITS

The present application is a Continuation-In-Part of application Ser. No. 09/396,714 filed on Sep. 15, 1999 now abandoned.

BACKGROUND OF THE INVENTION

1. Field of the Invention

The present invention relates to the field of tools and tool bits and more specifically, the present invention relates to the field of hand-held tools and machines that store interchangeable tool bits.

2. Background of the Invention

Many tools and machines allow for the use of tool bits that are releasably secured by a socket or a chuck at the tip of a shank. Many different types of tool bits also are presently available for use with such tools and machines. Typically, and just within a few minutes, a worker may require more than one such tool bit. A bit swap may have to be done quickly and while the worker is perched in a precarious position. Changing bits not only causes inconvenience but also safety problems for both the worker and bystanders. Difficulty in changing bits, losing bits while they are changed, or bits falling out from where they are stored all present safety hazards as these occurrences distract workers and may cause them to make sudden movements and loose their balance. Also, the lost bit may strike a bystander or a piece of equipment.

For hand tools, a convenient arrangement for bit storage is one where the bits are stored on the tool. An ideal design is one that minimizes tool manufacturing costs, time required for bit replacement, the likelihood that tool or bits will be dropped as bits are changed, and the maneuvers a worker has to undertake. Such a design enhances both safety and efficiency. All of the above considerations apply to hand-driven tools and even electrically- or compressed air-driven tools which are now used ever more widely but whose greater weight makes it even more imperative that bit interchange and storage be made as effortless as possible.

Examples of prior designs for the storage of tool bits in hand tools include U.S. Pat. Nos. 3,405,749; 3,667,518; 3,683,984; 3,753,455; 4,235,269; 4,273,173; 4,278,119; 4,327,790; 4,372,361; 4,372,362; 4,434,828; 4,440,048; 4,452,289; 4,463,788; 4,552,043; 4,552,044; 4,572,038; 4,716,795; 4,735,120; 4,793,222; 4,827,812; 4,841,597; 4,901,607; 4,924,733; 5,174,178; 5,265,504; 5,325,745; 5,335,409; 5,460,063; 5,499,562; 5,517,885; 5,522,291; 5,613,413; 5,881,615; D358,316; and D373,297. These patents present a myriad of different approaches to the problem of tool bit storage, but three general approaches can be discerned.

Many patented designs feature storage compartments that are located at the heel of the handle. This is the case in U.S. Pat. No. 5,174,178 where a worker must open a hinged door to access tool bits, and U.S. Pat. No. 5,613,413 where one must unscrew a cap to accomplish same. In any event, storage in the heel of the handle requires flipping the tool back and forth when interchanging tool bits as the worker (1) removes the bit from the tip of the shank, (2) reaches to the back of the handle for replacement bit, (3) stores away the tool bit no longer desired, and (4) reaches back to the tip of the of the shank to install the new bit at the tip. These designs limit the versatility of the tool in that shorter tool bits would be recessed too far into their compartments for one to be able to remove them and longer bits cannot be stored at all. Moreover, bit storage at the heel of the handle stymies power driving inasmuch as it limits the amount of space available for internal electrical componentry or for coupling with a rotating chuck.

Also, there are designs where the bits are stored in the handle near to and parallel to the shaft, but with their tips protruding from the handle. See e.g. U.S. Pat. No. 4,452,289. This arrangement has two distinct disadvantages: with the tips so exposed one may scratch oneself and others as well as neighboring objects and, again, the exposed tips of the tool bits may attract electrical arcing near the workman's hand that cause him to drop the tool or damage the battery or the motor of an electrically-driven tool.

U.S. Pat. No. 4,278,119 discloses a hand tool with a storage member coaxial with the shaft wherein tool bits are completely stored in a spring-biased storage member. This design has several disadvantages. First, one is limited to using only tool bits that are short enough to fit in the storage member cavities. Also, this design adds unnecessarily to the length of the device.

Other designs feature tool bits stored in grooves inscribed in the hand-gripped cylindrical surface of the handle and held in place by various attachment means. In U.S. Pat. No. 3,667,518 the bits are retained in the grooves by an elastic O-ring stretched around the circumference of the handle. This design has the disadvantage that in order to remove one tool bit from its recess an additional step is required whereby a bit retaining O-ring first must be rolled out of the way. Further, once the O-ring is moved, the potential now exists for the other bits to fall out of their grooves.

Most recently, U.S. Pat. No. 5,881,615 awarded to Dahl and Elvebak discloses a handle with tool bits stored in grooves comprised therein and where the tool bits are held in place by means of sliding panels. However, a bit has the potential of falling out of its groove if, inadvertently, one fails to slide the panel so that it covers the bit, or if, because of wear and tear, the panel slides out of position, thereby exposing the bit.

Also, none of the prior art devices offers an unhindered full length view of stored bits. This is crucial, particularly in light of increased popularity of double-headed bits.

There is a need in the art for a tool or machine wherein tool bits are stored by means that would accommodate a wide variety of tool bits, minimize the manual steps required to interchange and store tool bits, and limit the likelihood of the bits falling out from the storage means. For hand tools, a convenient arrangement for bit storage is where the bits are stored on the tool's handle. The most successful design would minimize manufacturing costs at the same time as it minimizes the effort required for bit replacement. All of the above considerations apply to hand-driven tools and power tools.

SUMMARY OF THE INVENTION

An object of the present invention is to provide a tool or machine that comprises storage for tool bits and that overcomes the disadvantages in the prior art.

Another object of the present invention is to provide a tool that allows rapid tool bits storage. A feature of the present invention is that the bits snap into place in handle comprised grooves. An advantage of the present invention is that secure storage may be effected by means of a single finger movement.

Still another object of the present invention is to provide a multi functional handle for a tool. A feature of the present invention is that tips of tool bits are removably received by grooves in the handle. An advantage of the present invention is that bits of different lengths and serving different functions can be used in conjunction with the present invention.

Yet another object of the present invention is to provide a device that allows for quick interchange of tool bits. A feature of the present invention is that the bits are fully visible from their storage location and that the bases of the bits are located in a region on a tool whence they are easily removable. An advantage of the present invention is that it allows easy access to the bits, quick identification of the bit to be used, and one-handed operation for bit removal and bit replacement at their storage location.

A further object of the present invention is to provide an economical and sturdy tool handle that allows storage of tool bits. A feature of the present invention is that the handle may be integrally molded from a single widely available material. A further feature of the present invention is that the handle comprises no moving parts. An advantage of the present invention is that it can be manufactured at low cost and that it has a very long useful life.

In brief, an economical and sturdy device for storing bits is provided comprising a tool handle wherein a plurality of bits snap into grooves where they are easily identified and whence they can be quickly removed.

Specifically, the invention provides for a bit-storing handle comprising a surface of the handle defining a channel adapted to retain the bit; a fulcrum point within the channel; and a means for rotating the bit about said fulcrum point.

The invention also provides for a tool for storing bits, comprising: a handle; a surface of the handle defining a plurality of channels adapted to retain the bits such that the longitudinal axis of the retained bits are co-linear to the longitudinal axis of the handle; a fulcrum point within each of the channels; and a means for rotating each of the bits about each fulcrum point so that upon rotation, the bits extend radially from the longitudinal axis of the handle for their removal from the handle.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

The present invention provides storage for tool bits in a tool handle. The tool bits are held in grooves or channels comprised in the handle. These grooves comprise resilient material such that the bits can be inserted by snapping the tools into the grooves and then held in place by friction and/or the resiliency of the material. Also, means are provided allowing quick removal of the bits from the grooves.

Figure 1:
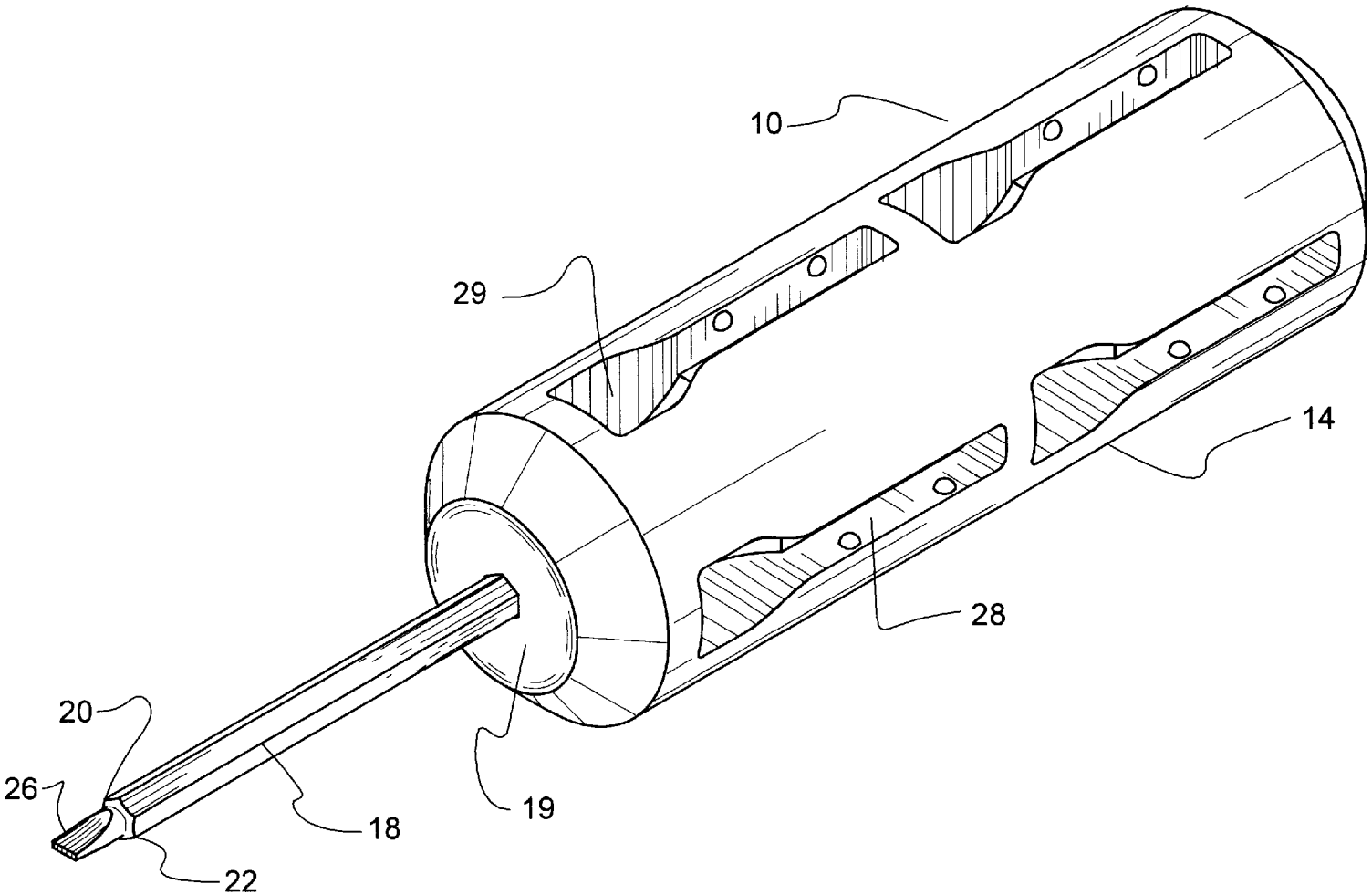
FIG. 1 is a perspective view of a hand tool in accordance with the present invention.

Referring to FIG. 1, an exemplary embodiment of the proposed invention is schematically depicted in conjunction with a manually driven tool generally designated as numeral 10. The tool comprises a handle 14, a shank 18 having one end 19 embedded in the handle, and a second end 20 of the shank adapted to receive a tool bit 26 via a bit retention means 22. While the retention means 22 is not part of the instant invention, suffice it to say that any retention means is suitable for holding a complementary-shaped bit. Exemplary retention means includes, but are not limited to, a ball-detent configuration, a chuck, a ratchet screwdriver head, and a male-female socket configuration.

Co-linear with the longitudinal axis a of the handle 14 is a means for retaining bits 26. The retaining means 28 are slotted regions extending along the longitudinal axis $\alpha$ of the handle. The bits generally are of a dual-headed, cylindrical configuration, with diameters ranging from between 1.5 to 13 mm. (or 1/16 to ½ in).

Figure 2:
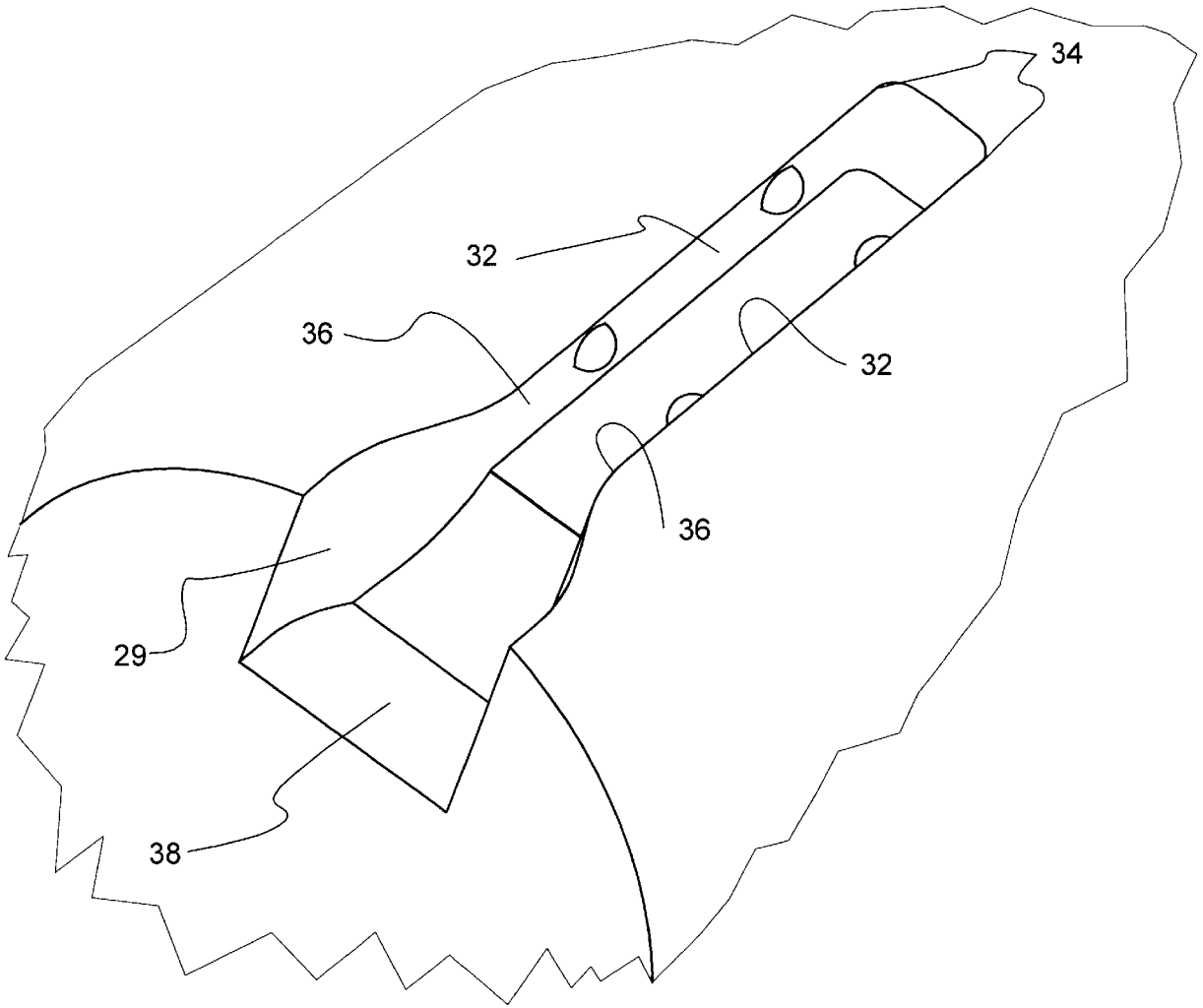
FIG. 2 is a cross-sectional view of a tool bit-holding handle, taken along line 2—2 of FIG. 1, in accordance with features of the present invention.

FIG. 2 provides detail for an exemplary bit retaining means. As depicted in FIG. 2, the bit retaining means includes a longitudinally-extending channel 30 adapted to receive a bit (not shown). Walls 36 of the channel extend inwardly in a radial direction and terminate in a channel floor 31. Opposing edges 32 of the channel 30 define inwardly directed reversibly deformable protrusions 34 adapted to frictionally engage a bit in a snap-fit interaction resulting in the channels receiving and retaining the bits. The protrusions exist substantially along the edges 32 of the channel 30.

The retaining means 28 further provides a means for removing a bit situated in the channel. The removing means includes a region 38 of the floor 31 forming a depression, wherein the depression is inwardly directed and adapted to receive a finger extending therein.

Figure 3A:
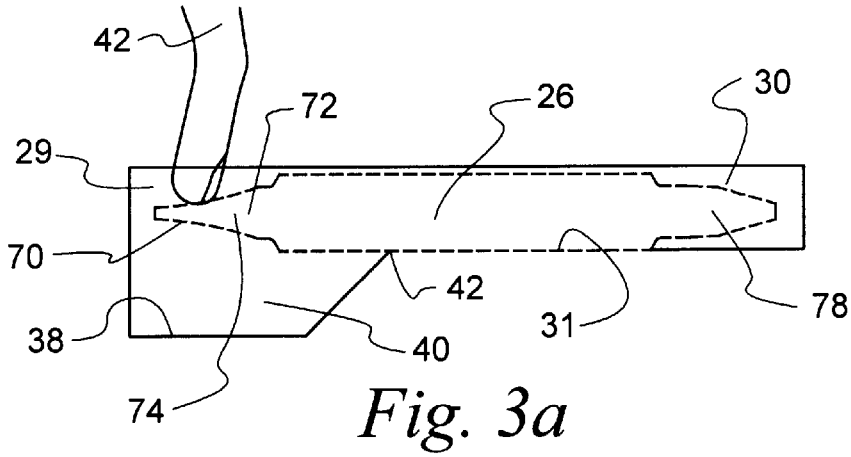
FIG. 3A is a side sectional view of the tool bit-holding handle, but with a bit retained therein, taken along lines 3—3 of FIG. 2.
Figure 3B:
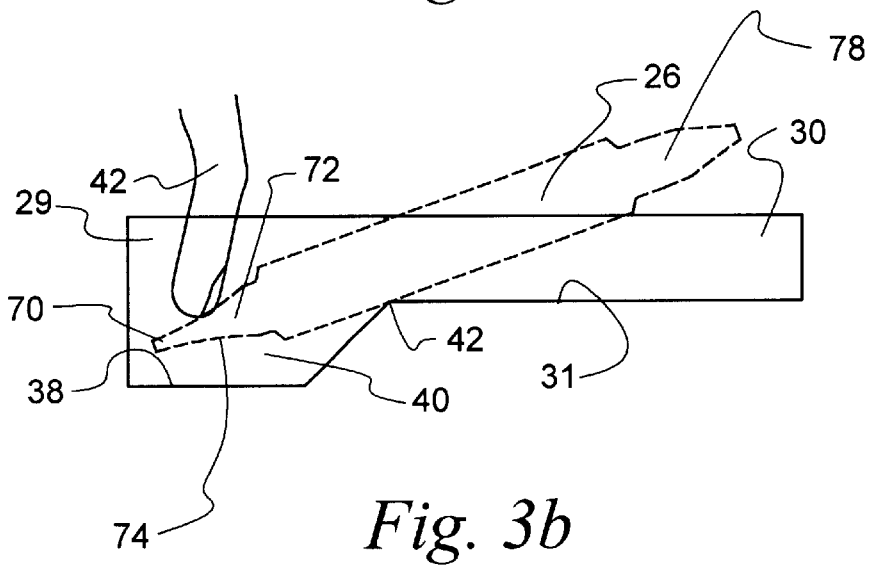
FIG. 3B is a side sectional view of the tool bit-holding handle, with a bit extending therefrom, in accordance with features of the present invention.

FIG. 3A is a side view of the channel, taken along line 3-3 of FIG. 2. As depicted therein, when a bit 26 is retained in the channel, the depression 38 and the bit 26 define a space 40. FIG. 3B depicts the space being utilized upon the application of digital pressure 42 to a proximal portion of the bit so as to facilitate rotatably positioning the bit 26 along a fulcrum point 42 for easy bit removal. The fulcrum point 42 is defined at a point of medial, inward deviation of the channel floor 31, whereby the deviation is toward the longitudinal axis of the handle. To facilitate access to the bit, the opposing edges 32 of one end of the channel 30 diverge laterally to define an opening 29. The opening 29 is adapted to receive a human finger or some other means for applying pressure to the nested bit and in a direction generally perpendicular to the longitudinal axis of the bit so as to cause the bit to rotate about the fulcrum point 42 and outwardly as depicted in 3B.

Figure 3C:
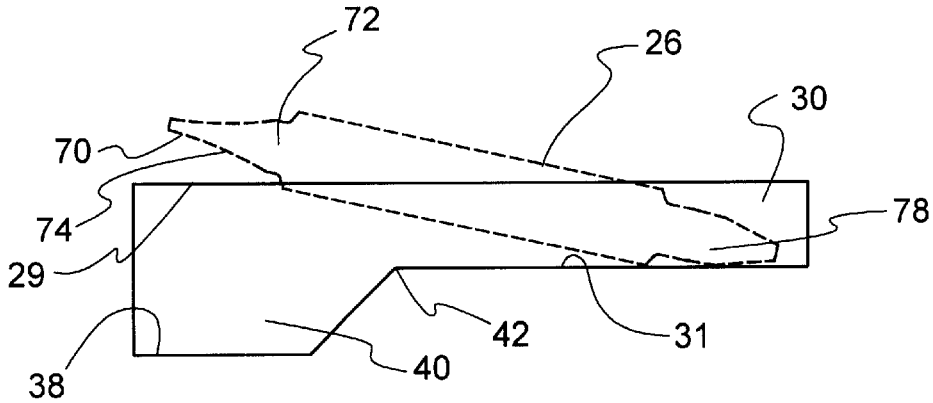
FIG. 3C is a side sectional view of the tool bit-holding handle, with a bit extending therefrom in accordance with an alternative method for the present invention.

Referring to FIGS. 1, 2, 3A, 3B and 3C, the use of pressure to rotate the tool bit 26 about the fulcrum point 42 as detailed above can be difficult in cold weather because the material used to fabricate the handle 14 will have a tendency to become "stiffer" thereby generating a stronger hold upon the bit 26 when the bit is forcibly positioned in the storage channel 30. An alternative to rotating the bit 26 about a fulcrum point in the channel 30, is to lift the bit 26 from the channel with the finger of the user. FIG. 3C depicts the position of the bit 26 after being lifted by the user's finger.

Cold weather access to the bit 26 is promoted by dimensioning and configuring the opening 29 to allow the finger of an user wearing gloves to be positioned between a first end 70 of the bit 26 and the storage channel walls 36. Positioning the finger adjacent to a side portion 72 of the first end 70, allows the user to slide the first end 70 out of the channel 30. However, removal of the first end 70 of the bit 26 from the channel 30 may still be difficult. To further facilitate removal of the first end 70 of the bit 26 from the channel 30, the space 40 beneath the first end 70 is dimensioned and configured to allow the glove covered finger of the user to be positioned between the first end 70 of the bit 26 and the depressed region 38 of the channel 30.

The channel floor 31 engages a relatively large portion of the bit 26 thereby limiting the insertion depth of the bit 26. The surface area of the depressed region 38, and the distance between the first end 70 of the bit 26 and the depressed region 38, configures the space 40 beneath a smaller portion of the bit 26. Thus, the channel floor 31 and the depressed region 38 cooperate to maintain a "finger space" under the bit 26 to position the user's finger against a bottom portion 74 of the first end 70 of the bit 26. Positioning the finger adjacent to the bottom portion 74 of the first end 70 of the bit 26, allows the finger to pull the first end 70 from the channel 30 by directing the removal force generated by the finger radially outward from the channel 30.

Thus, the "dual depth" channel 30 formed by the channel floor 31 and the depressed region 38, provides two methods of removing the tool bit 26 from the channel 30 of the tool handle 14. A first method allows a bit 26 to be removed from the channel 30 relatively quickly when a "downward" force is impressed upon the first end 70 of the bit 26. The downward force causes the bit 26 to pivot or rotate upon a fulcrum point 42 thereby elevating a second end 78 of the bit 26 from the channel 30. This method allows the bit 26 to be removed quickly from the channel 30, but requires a relatively large downward force from the user's finger due to the close proximity of the finger to the fulcrum point 42. The required downward force may be especially great in cold weather.

A second method allows a bit 26 to be removed from the channel 30 when the user's finger provides an "upward" force against the bottom portion 74 of the first end 70 of the inserted bit 26 thereby removing the first end 70 instead of the second end 78 of the bit 26. The second method is relatively slower than the first method due to the time required to position the finger into the space 40 and under the first end 70 of the bit 26. However, a relatively minimal amount of force is required from the user's finger to remove the first end 70 and ultimately the entire bit 26 from the channel 30.

Figure 4:
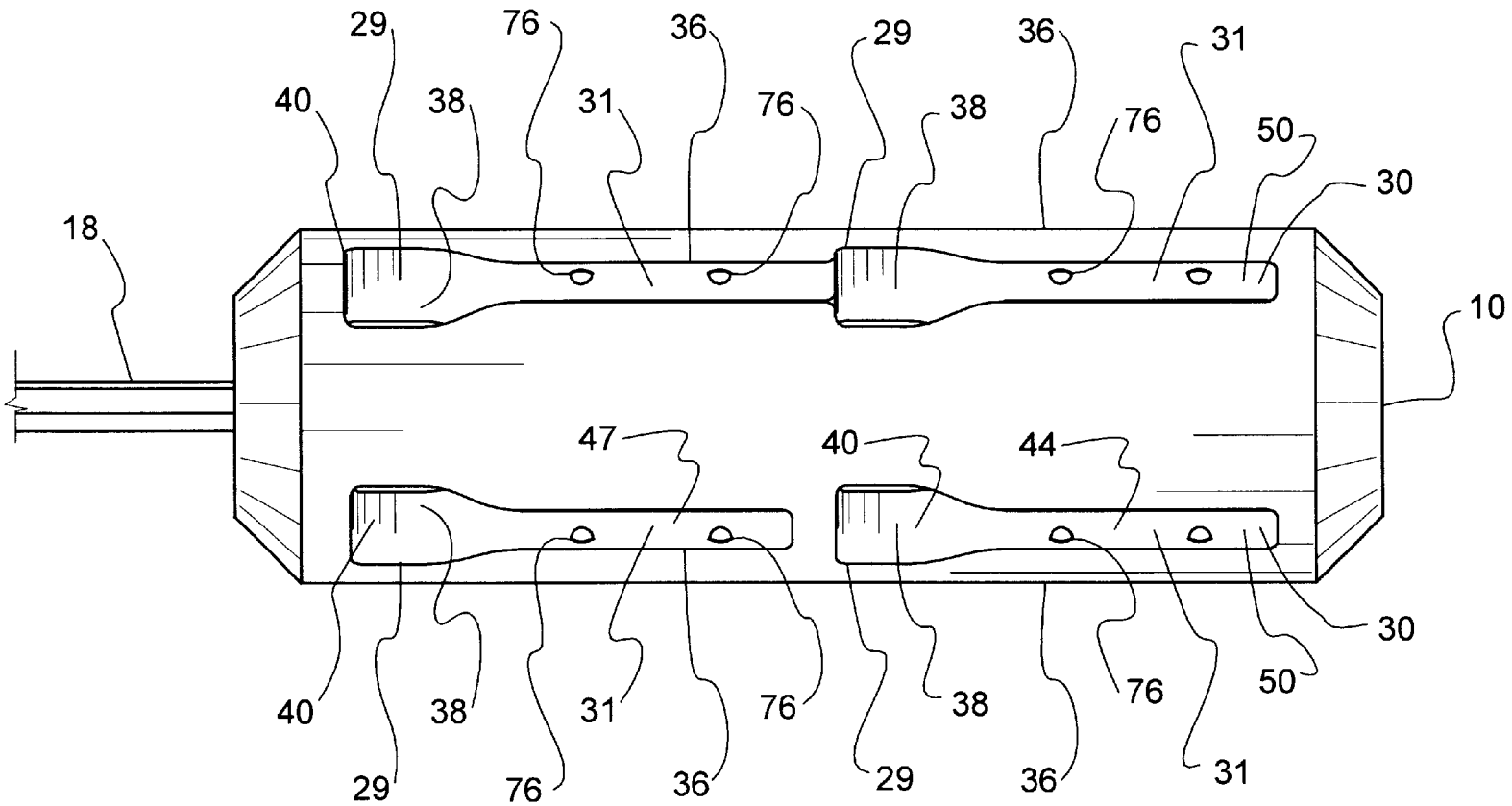
FIG. 4 is a perspective view of another embodiment of a hand tool in accordance with the present invention.

Referring now to FIG. 4, the openings 29 and the corresponding space 40 therein may be dimensioned and configured as detailed above to allow a plurality of bits 26 to be stored in one channel 30. To provide better retention of the multiple bits 26 including relatively "short" or "thin" bits 26, opposing wall projections 76 are located on the channel walls 36 to sufficiently grasp portions of each bit 26 placed in the channel 30 to maintain the position of the bits 26 irrespective of the orientation of the handle 14.

While a plurality of different sized and diameter bits can be utilized and stored by the bit retaining means, a preferred configuration is shown in 3B wherein the depth d of the channel 30 is such that the surface of a bit does not protrude above the opening of the channel. Stated another way, the longitudinally extending surface of the bit should not remain intermediate the opposing lips of the channel. Otherwise, discomfort during manual operation of the handle could result. Also, a countersunk bit minimizes the possibility of snagging of a bit on clothing and other structures, and possible dislodging of the bit.

As depicted in FIG. 1, a plurality of channels can be integrally molded to the handle, and circumferentially arranged about the handle.

Figure 5:
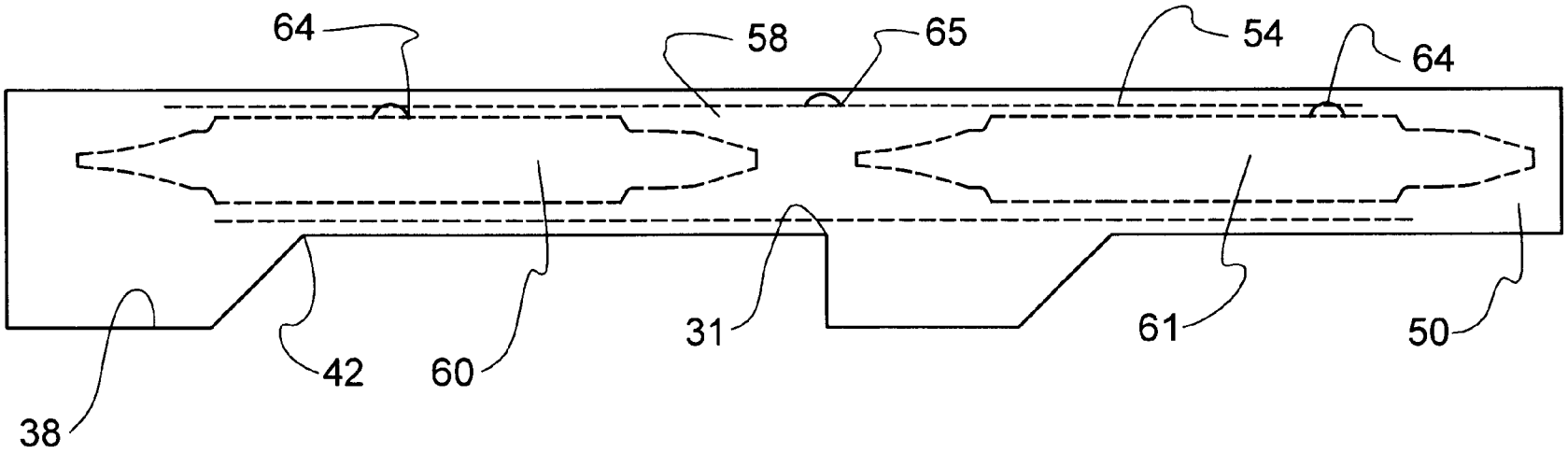
FIG. 5 is a side sectional view of the tool bit-holding handle, but with a bit-holder retained therein, taken along lines 5—5 of FIG. 4.

As depicted in FIG. 4, which is modification of FIG. 1, the bit-retaining channels can be of different lengths so that the same tool handle may be used for bits serving widely different functions or manufactured by different manufacturers. The handle 10 is shown to comprise a short channel 44, a channel of intermediate length 47, and a long channel 50. Specifically, one or more channels may be made of such length as to accommodate commercially available four-in-one bit-holders. This is depicted in FIG. 5 which is a modification of FIG. 3A, as it shows a side view of channel 50 wherein a four-in-one bit-holder 54 has been placed. The bit-holder 54 typically comprises a hexagonal cross-sectional sleeve 58 designed to slidably accommodate two complementary shaped dual head bits 60 and 61. The sleeve 58, and the bits 60 and 61 each may be provided with a ball-detent mechanism 64, the later of which is to prevent the bit from sliding longitudinally when fitted at the end of the tool shaft 18. Similarly, the sleeve 58 may also define a ball-detent 65 so as to prevent its longitudinal sliding after same is slidably received into the bit end 20 of the shaft.

A variant of the arrangement depicted in FIG. 5 is where a plurality of bits or bit-holders are nested in the channel 50. In such scenarios, a plurality of the finger access openings 29 also are provided, as illustrated in FIG. 4.

The opposing lips 34 of the channel are in integrally molded with the handle. A myriad of materials can be utilized to form the handle. A salient feature of the material is that it be reversibly deformable so as to facilitate the friction fit of the bit in the channel. As such, rigid, semi-rigid, or even pliable material can be utilized for handle material, just as long as the handle can be utilized to impart rotational force to the bit end 20 of the shaft. Indeed, a portion of the handle defining the channels 30 can be removably attached to either the shaft 18 or to another portion of the tool affixed to the shaft.

As noted above, a salient feature of the invention is the provision for simultaneously viewing the entire bit without first manipulating the holding means. This provision is particularly advantageous when dealing with two-headed bits, each bit having a different configuration.

While the invention has been described in the foregoing with reference to details of the illustrated embodiment, these details are not intended to limit the scope of the invention as defined in the appended claims. For example, while FIG. 1 depicts the invention in use with a screw-driver type tool, other tool handles also can be so modified. As such, handles attached to a saw blade, a gimlet, a drill, a rachet tool, or other similar devices can be configured to the invented bit-retaining configuration.

The embodiment of the invention in which an exclusive property or privilege is claimed is defined as follows:

1. A tool bit storing channel:

means for retaining the tool bit within said storage channel;

means for preventing engagement between the tool bit and the user; and means for promoting engagement between a finger of the user and a first end of the tool bit such that said first end of the tool bit may be lifted from storage channel by the finger of the user.

2. The handle as recited in claim 1 wherein said retaining means includes opposing protrusions positioned in said storage channel to forcibly engage the tool bit thereby maintaining the position of the tool bit in said storage channel irrespective of the orientation of said storage channel.

3. The handle as recited in claim 1 wherein said retaining means includes means for frictionally receiving the tool bit thereby maintaining the position of the tool bit in said storage channel irrespective of the orientation of the said storage channel.

4. The handle as recited in claim 1 wherein said engagement preventing means includes configuring said storage channel to position the tool bit below the surface of the tool handle.

5. The handle as recited in claim 1 wherein said promoting means includes an opening dimensioned to allow the finger of an user to be positioned between the first end of the tool bit and a storage channel wall.

6. The handle as recited in claim 1 wherein said promoting means includes a space dimensioned to allow the finger of an user to be positioned between the first end of the tool bit and a storage channel floor.

7. A tool handle that stores tool bits comprising:

a plurality of tool bit storage channels;

means for retaining the tool bits in said storage channels; and means for promoting engagement between a finger of the user and a first end of a selected tool bit stored in one of said storage channels such that the first end of the selected tool bit may be lifted from said storage channel by the finger of the user.

8. The handle as recited in claim 7 wherein said retaining means includes means for protrusions positioned in said storage channel to forcibly engage the tool bit thereby maintaining the position of the tool bit in said storage channel irrespective of the orientation of said storage channel.

9. The handle as recited in claim 7 wherein said retaining means includes means for frictionally receiving the tool bit thereby maintaining the position of the tool bit in said storage channel irrespective of the orientation of said storage channel.

10. The handle as recited in claim 7 wherein said promoting means includes an opening portion in each of said plurality of storage channels, said opening portion being dimensioned to allow the finger of an user to be positioned between the first end of the selected tool bit and a storage channel wall.

11. The handle as recited in claim 7 wherein said promoting means includes a dimensioned to allow the finger of an user to be positioned between the first end of the selected tool bit and a storage channel floor.

12. The handle as recited in claim 10 wherein at least one of said plurality of storage channels includes a plurality of openings separated a predetermined distance, each of said plurality of openings being dimensioned to allow the finger of an user to be positioned between the first end of the selected tool bit and a storage channel wall thereby allowing a plurality of tool bits to be removably received in at least one of said plurality of storage channels.

13. The handle as recited in claim 11 wherein at least one of said plurality of storage channels includes a plurality of openings separated a predetermined distance, each of said plurality of openings being dimensioned to allow the finger of an user to be positioned between the first end of the selected tool bit and a storage channel wall thereby allowing a plurality of tool bits to be removably received in at least one of said plurality of storage channels.

14. The handle as recited in claim 7 wherein said storage channels includes means for preventing engagement between the tool bit and the user.

15. The handle as recited in claim 14 wherein said engagement preventing means includes configuring said storage channels to position the tool bits below the surface of the tool handle.

16. A handle for storing a tool bit comprising:

a storage channel;

means for retaining a tool bit in said storage channel; and means for promoting engagement between a finger of an user and a first end of the tool bit such that said first end of the tool bit may be rotated about a fulcrum point in said storage channel by the finger of the user thereby removing a portion of the tool bit from said storage channel.

17. The handle as recited in claim 16 wherein said promoting means includes an opening dimensioned to allow the finger of an user to be positioned between the first end of the tool bit and a storage channel wall.

18. The handle as recited in claim 16 wherein said promoting means includes a space dimensioned to allow the finger of an user to be positioned between the first end of the tool bit and a storage channel floor.

19. The handle as recited in claim 16 wherein said storage channel includes means for preventing engagement between the tool bit and the user.

20. The handle as recited in claim 19 wherein said engagement preventing means includes configuring said storage channel to position the tool bit below the surface of the handle.

* * * * *

UNITED STATES PATENT AND TRADEMARK OFFICE

CERTIFICATE OF CORRECTION

PATENT NO. : 6,435,065 B2
DATED : August 20, 2002
INVENTOR(S) : Burt Kozak and Ira M. Kozak It is certified that error appears in the above-identified patent and that said Letters Patent is hereby corrected as shown below:

Column 6,
Line 60, insert the following text after "1. A": -- tool handle that stores tool bits comprising: a -- and replace "storing" with -- stores --

Column 8,
Lines 13 and 14, replace "openings" with -- spaces --
Line 33, after "the tool bit may be" insert -- lifted from said storage channel by the finger of the user or such first end of the tool bit may be --

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,435,065 B2
DATED : August 20, 2002
INVENTOR(S) : Burton Kozak and Ira M. Kozak It is certified that error appears in the above-identified patent and that said Letters Patent is hereby corrected as shown below:

Title page,
Insert Item -- [73] Combined Products, Inc.
4010 West Belden Avenue
Chicago, IL 60639-3702 --

Insert attorney of record: -- Cherskov & Flaynik --

Signed and Sealed this

First Day of April, 2003

JAMES E. ROGAN
*Director of the United States Patent and Trademark Office*